US005211400A

United States Patent [19]

Hall et al.

[11] Patent Number: 5,211,400

[45] Date of Patent: May 18, 1993

[54] GOLF PUTTING AID

[76] Inventors: John R. Hall, P.O. Box 1526, Alvin, Tex. 77512; Charles R. Epps, 166 Warrenton, Houston, Tex. 77024

[21] Appl. No.: 882,944

[22] Filed: May 14, 1992

[51] Int. Cl.[5] ..... A63B 69/36

[52] U.S. Cl. ..... 273/187.6; 273/187.3; 273/178 R

[58] Field of Search ..... 273/187.6, 187.3, 163 R, 273/163 A, 164, 187.5; 33/262

[56] References Cited

U.S. PATENT DOCUMENTS 1,091,186 3/1914 Brown ..... 273/187.6 X 3,853,325 12/1974 Easterbrook ..... 273/187.6

*Primary Examiner*—George J. Marlo

*Attorney, Agent, or Firm*—Kenneth A. Roddy

[57] ABSTRACT

A rotatable horizontal sighting ring at the upper end of a vertical support post has a ball/club path marker extending thereacross and outwardly therefrom and a clubhead alignment marker extending transversly across the sight ring to form a cross hair sight at the center of the ring. A smaller ball sight ring approximately the same diameter as a golf ball is disposed within the larger sighting ring at one side of the clubhead alignment marker. In use, the larger sighting ring is positioned such that when viewed by a golfer in a standing position, the smaller ball sight ring is superposed over the golf ball and the ball/club path marker is aligned with the desired ball path and the clubhead alignment marker will be perpendicular to the desired golf ball path. A lower ball alignment member may also be installed on the lower end of the post vertically below the sighting ring or used separately. The lower ball alignment member has lower clubhead alignment marker extending outwardly from the post, an arcuate ball receptacle at one side of the lower clubhead alignment marker, and a lower ball/club path marker extending rearwardly from the arcuate receptacle at a right angle to the lower clubhead alignment marker. The lower ball alignment member is positioned with its ball/club path marker forming an extension of the desired ball path and the cross hair sight of the upper sight ring is positioned such that the upper and lower ball/club path markers and upper and lower clubhead alignment markers are superposed.

9 Claims, 4 Drawing Sheets

GOLF PUTTING AID

BACKGROUND OF THE INVENTION

1. Field of the Invention

This invention relates generally to golf training and practice devices, and more particularly to a golf putting aid which utilizes an adjustable cross hair sighting member spaced above the ball positioned relative to a desired ball path and may be used with a lower ball alignment member having corresponding cross hairs such that the upper and lower sighting and alignment members may be used to position the head of the putter perpendicular to the desired ball path.

2. Brief Description of the Prior Art

In making a successful putting shot, it is important for the golfer to keep his head steady and to make sure that the "sweet spot" of the putter head contacts the ball on center and that the face of the putter is perpendicular to the desired ball path throughout the stroke.

There are several patents which disclose training and practice aids to help the golfer to keep his head steady, most of which are used during a drive or fairway shot and do not train the golfer in determining a proper ball path and maintaining the head of the putter perpendicular to the desired ball path during a putting stroke.

British Patent 435,483 discloses a teeing device with a triangular teeing hole upon which the ball rests and a sighting device comprising a segment of a circle which is positioned above the ball to cover a portion of the ball and expose a white band around the rear of the ball representing the proper impact point to hit the ball.

British Patents 780,515 and 1,468,170, and U.S. Pat. No. 3,853,325 to Esterbrook disclose sighting devices having a ring or a ball which are positioned above the ball to teach a proper steady head position during the swing. There is no provision for determining the ball path or aligning the club head relative to the ball path.

Brown, U.S. Pat. No. 1,091,186 discloses another sighting device having a ring with crossed wires which is positioned above the ball to teach a proper steady head position during the swing. There is no provision for determining the ball path or aligning the club head relative to the ball path.

Williams, U.S. Pat. No. 1,677,261 discloses another sighting device having an opaque plate with a slot running at right angles to the swing of the club which is positioned above the ball to teach a proper steady head position during the swing. There is no provision for determining the ball path or aligning the club head relative to the ball path.

Gutierrez et al, U.S. Pat. No. 3,857,570 discloses a generally rectangular U-shaped frame having an upper horizontal member which overlies the center of the lower U-shaped portion and extends substantially the length of the lower portion. The device trains the golfer to maintain the putter vertical through the back-stroke and follow-through and prevents the putter from rising at each end of the stroke.

Doerrfeld, U.S. patent discloses a golf training device having a two-piece sighting member at the end of an upwardly curving arm. The bottom piece of the sighting member has a clubhead line thereon which and the top piece has an oval sighting aperture and a swing path direction line thereon. The top piece can be rotated relative to the bottom piece such that the clubhead line can be offset with respect to the swing path line. By offsetting the clubhead relative to the swing path of the club, the golfer learns to execute a "hook" shot or a "fade" shot.

The present invention is distinguished over the prior art in general, and these patents in particular by a golf putting aid having a rotatable horizontal sighting ring at the upper end of a vertical support post. The sighting ring has a ball/club path marker extending thereacross and outwardly therefrom and a clubhead alignment marker extending transversly across the sight ring to form a cross hair sight at the center of the ring. A smaller ball sight ring approximately the same diameter as a golf ball is disposed within the larger sighting ring at one side of the clubhead alignment marker. In use, the larger sighting ring is positioned such that when viewed by a golfer in a standing position, the smaller ball sight ring is superposed over the golf ball and the ball/club path marker is aligned with the desired ball path and the clubhead alignment marker will be perpendicular to the desired golf ball path. A lower ball alignment member may also be installed on the lower end of the post vertically below the sighting ring or used separately. The lower ball alignment member has lower clubhead alignment marker extending outwardly from the post, an arcuate ball receptacle at one side of the lower clubhead alignment marker, and a lower ball/club path marker extending rearwardly from the arcuate receptacle at a right angle to the lower clubhead alignment marker. The lower ball alignment member is positioned with its ball/club path marker forming an extension of the desired ball path and the cross hair sight of the upper sight ring is positioned such that the upper and lower ball/club path markers and upper and lower clubhead alignment markers are superposed.

SUMMARY OF THE INVENTION

It is therefore an object of the present invention to provide a golf putting aid which will train golfers to keep their head steady during a putting stroke.

It is another object of this invention to provide a golf putting aid which will train golfers to maintain the face of the clubhead perpendicular to the desired ball path during a putting stroke.

Another object of this invention is to provide a golf putting aid which has a ball alignment member with ball/club path marker which can be positioned to form an extension of a desired ball path and a clubhead alignment marker which will position the clubhead perpendicular to the desired ball path.

Another object of this invention is to provide a golf putting aid which has a sighting ring spaced vertically above a ball alignment member with a ball/club path marker and a clubhead alignment market perpendicular thereto which will allow the golfer to observe and maintain the club head perpendicular to the desired ball path during a putting stroke.

Another object of this invention is to provide a golf putting aid which has a sighting ring approximately the same diameter as the cup on the green and a ball sight member approximately the same diameter as the tall to develop a feel for the relative size of the target and ball.

A further object of this invention is to provide a golf putting aid which has a ball alignment member with a lower ball/club path marker and a lower clubhead alignment marker and a sighting ring spaced vertically thereabove which has a ball sight and an upper ball/club path marker and lower clubhead alignment marker which can be superposed to allow the clubhead to pass between the superposed members while being observed during a putting stroke.

Another object of this invention is to provide a golf putting aid which has a sighting ring approximately the same diameter as the cup on the green and a ball sight member approximately the same diameter as the ball to develop a feel for the relative size of the target and ball.

A still further object of this invention is to provide a golf putting aid which is simple in construction and economical to manufacture.

Other objects of the invention will become apparent from time to time throughout the specification and claims as hereinafter related.

The above noted objects and other objects of the invention are accomplished by a golf putting aid having a rotatable horizontal sighting ring at the upper end of a vertical support post. The sighting ring has a ball/club path marker extending thereacross and outwardly therefrom and a clubhead alignment marker extending transversly across the sight ring to form a cross hair sight at the center of the ring. A smaller ball sight ring approximately the same diameter as a golf ball is disposed within the larger sighting ring at one side of the clubhead alignment marker. In use, the larger sighting ring is positioned such that when viewed by a golfer in a standing position, the smaller ball sight ring is superposed over the golf ball and the ball/club path marker is aligned with the desired ball path and the clubhead alignment marker will be perpendicular to the desired golf ball path. A lower ball alignment member may also be installed on the lower end of the post vertically below the sighting ring or used separately. The lower ball alignment member has lower clubhead alignment marker extending outwardly from the post, an arcuate ball receptacle at one side of the lower clubhead alignment marker, and a lower ball/club path marker extending rearwardly from the arcuate receptacle at a right angle to the lower clubhead alignment marker. The lower ball alignment member is positioned with its ball/club path marker forming an extension of the desired ball path and the cross hair sight of the upper sight ring is positioned such that the upper and lower ball/club path markers and upper and lower clubhead alignment markers are superposed.

DESCRIPTION OF THE PREFERRED EMBODIMENT

Figure 1:
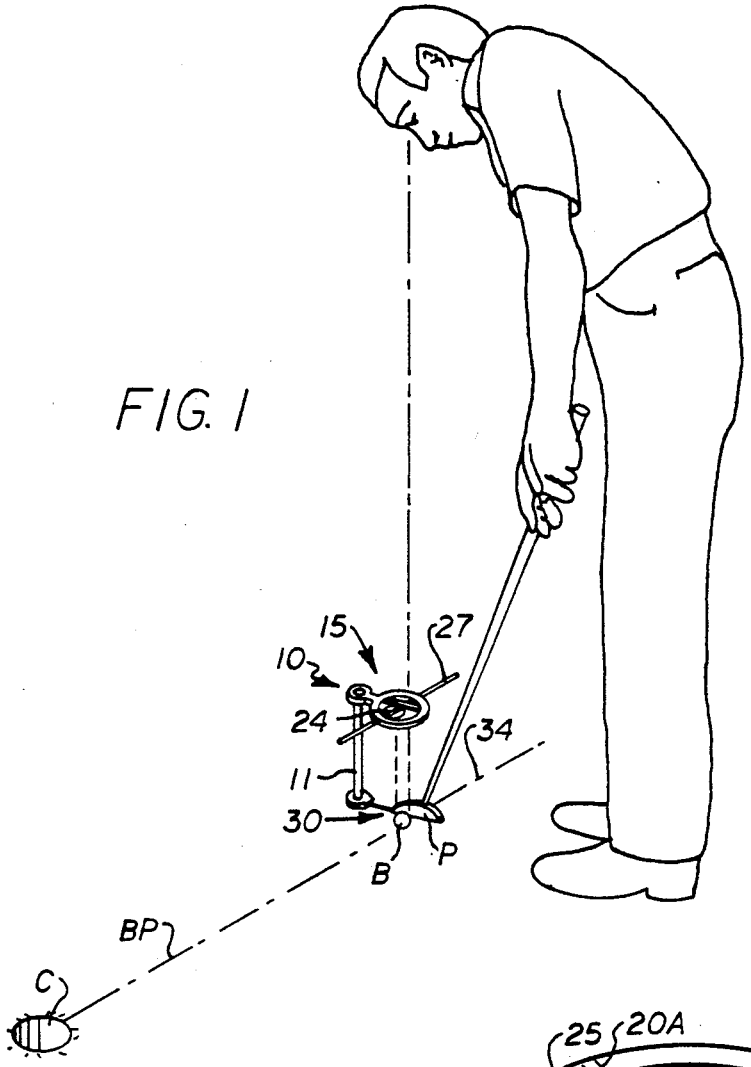
FIG. 1 is a perspective view of the golf putting aid in accordance with the present invention shown in position during a putting stroke.
Figure 2:
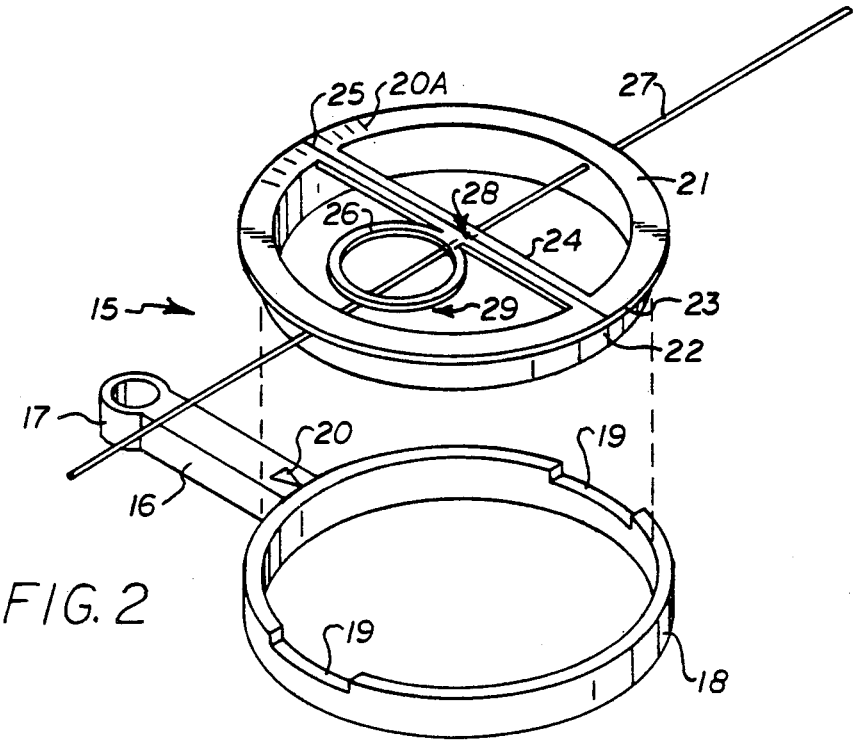
FIG. 2 is an exploded isometric view of the adjustable sighting member of the golf putting aid.
Figure 3:
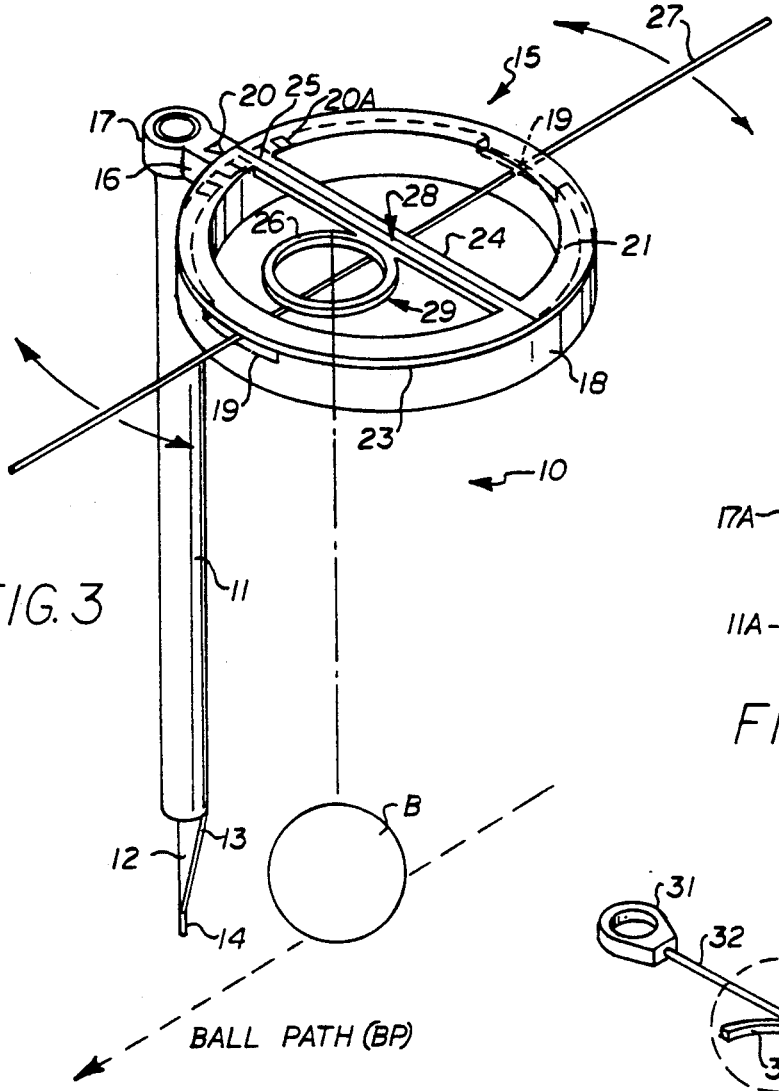
FIG. 3 is an isometric view of the golf putting aid assembled for outdoor use.
Figure 5:
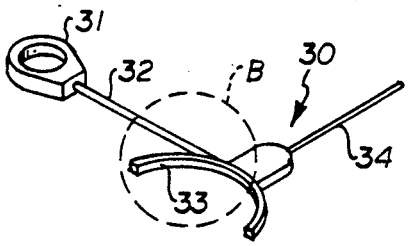
FIG. 5 is an isometric view of a lower ball alignment member of the golf putting aid.
Figure 4:
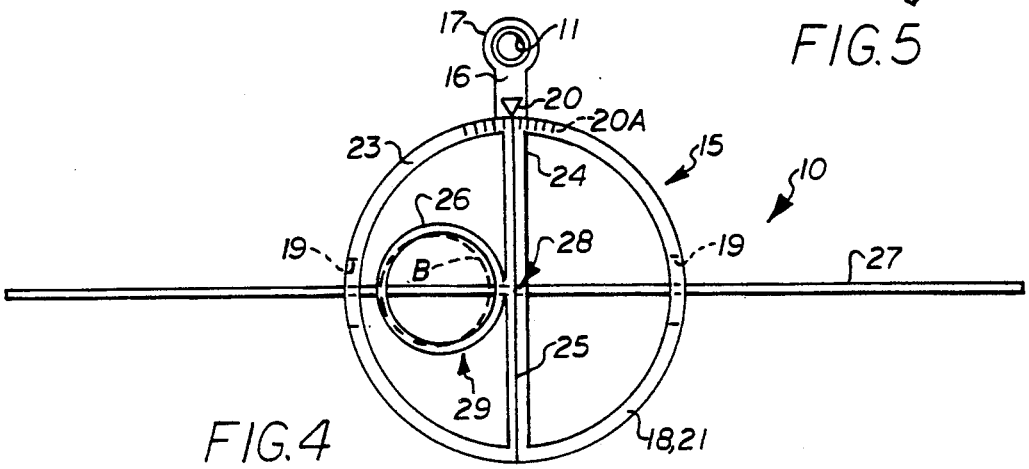
FIG. 4 is a top plan view of the embodiment of FIG. 2 showing the ball placement.
Figure 6:
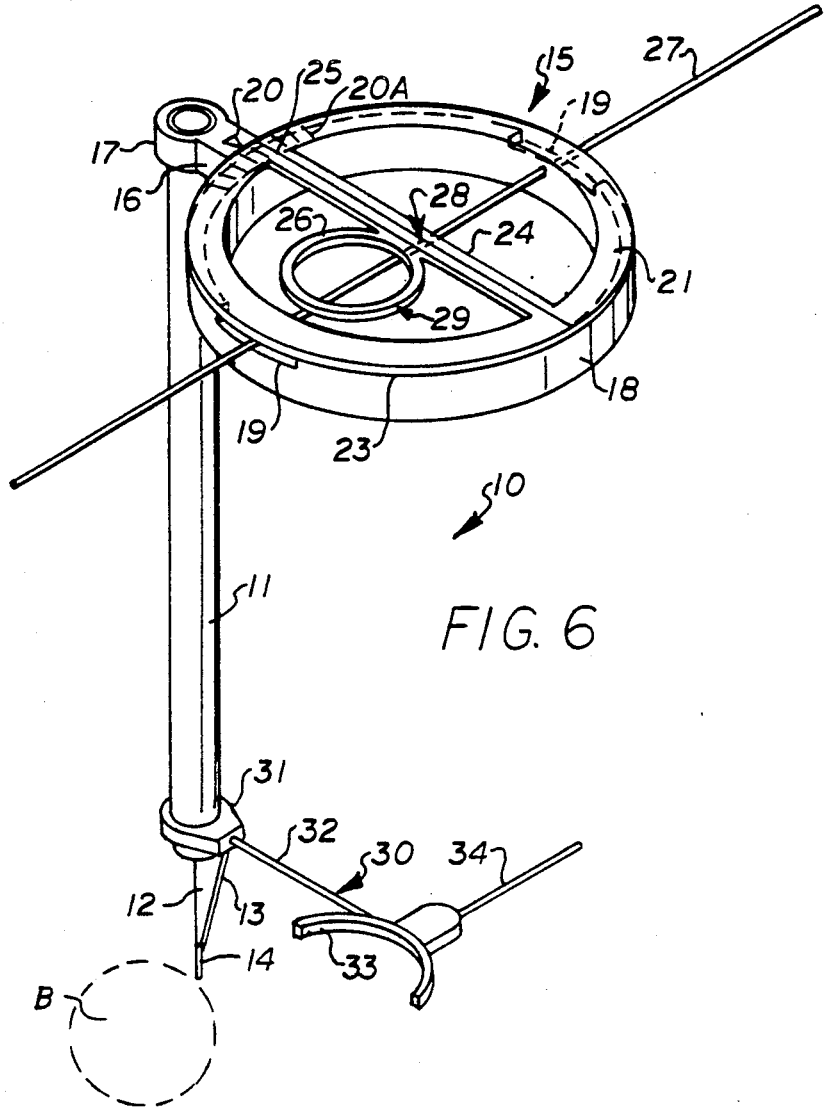
FIG. 6 is an isometric view of the golf putting aid assembled for outdoor use having the lower ball alignment member installed on the support post.
Figure 7:
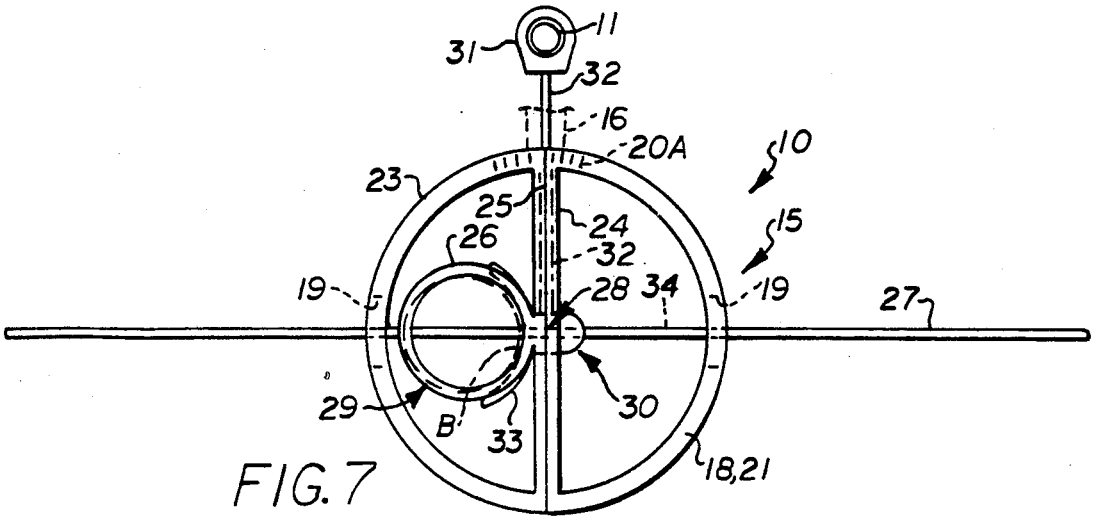
FIG. 7 is a top plan view of the embodiment of FIG. 6 showing the ball placement.
Figure 8:
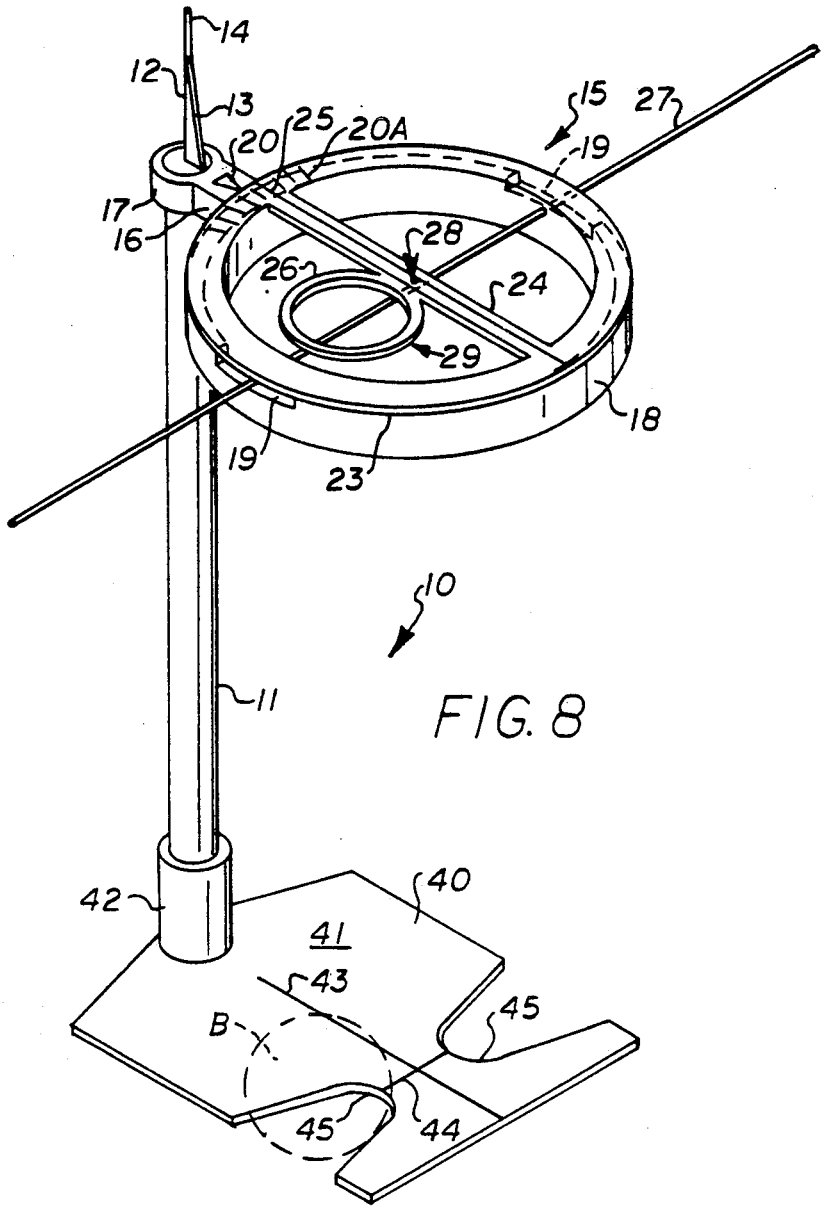
FIG. 8 is an isometric view of the golf putting aid assembled for indoor use.
Figure 9:
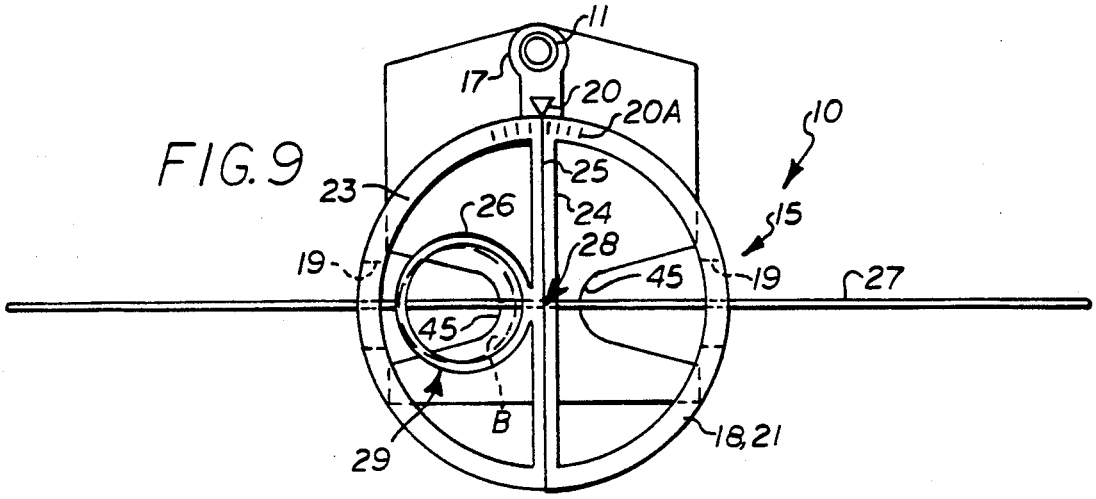
FIG. 9 is a top plan view of the embodiment of FIG. 8 showing the ball placement.

Referring to the drawings by numerals of reference, there is shown in FIG. 1, a preferred golf putting aid 10 for training golfers in the proper putting technique. The golf aid 10 is shown in use during a putting stroke. FIGS. 3 and 4 show an outdoor version of the putting aid, and FIGS. 6 and 7 show an outdoor version of the putting aid utilizing a lower ball alignment member. FIGS. 8 and 9 show an indoor version. FIG. 2 is an exploded view of the sighting device of the putting aid and FIG. 5 is a lower ball alignment member which may be used alone or in combination with the sighting device. In the following description, the components which are identical in the outdoor and indoor versions are given the same numerals of reference.

Figure 3A:
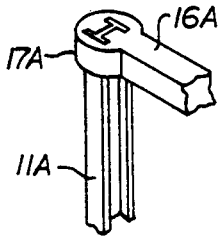
FIG. 3A is an isometric view of an alternate embodiment of the vertical support post of the golf putting aid.

With reference to FIGS. 3, 4, 6, 7, 8, and 9, the putting aid 10 has a tubular vertical support post 11 which is approximately 10" in length and ½" in diameter. While a tubular support post is described hereinafter, it should be understood that the support post may be of other shapes, such as in the form of an I-beam shape 11A, as shown in FIG. 3A with the components which are received thereon having a correspondingly shaped aperture. One end of the support post 11 is provided with an extension 12 having a longitudinal flat fin portion 13 which extends radially outward from the support post and tapers angularly inward and terminates in a pointed end 14. The opposed end of the vertical support post 11 has no extension. In outdoor use (FIGS. 3, 4, 6, and 7), the vertical support post 11 is positioned with the extension 12 downward to penetrate the ground, and the fin portion 13 prevents accidental rotation of the support post about its longitudinal axis. In indoor use (FIGS. 8 and 9), the vertical support post 11 is positioned with the extension 12 pointing upwardly and its opposed end is received in a base member (described hereinafter).

Referring additionally to FIG. 2, an adjustable sighting device 15 is secured to the vertical support post 11. The adjustable sighting device 15 has a horizontal arm 16 with a collar 17 at one end and a flat ring 18 at the opposite end. The inside diameter of the collar 17 is of sufficient diameter to be slidably received and frictionally and rotatably engaged on the vertical support post 11. The diameter of the ring 18 is approximately 4¼", or approximately the same diameter as the diameter of the cup into which the golf ball is to be putted. The top surface of the ring 18 has a pair of diametrically opposed circumferential slots 19. An index mark 20 is located on the arm 16.

A second flat ring 21 has a lower portion 22 and a circumferential lip 23 extending a short distance radially outward from the top end. The outside diameter of the lower portion 22 is sufficient to be slidably and rotatably received within the inside diameter of the ring 18. The circumferential lip 23 rests on the top surface of the ring 18 and maintains the ring 21 rotatably engaged within the ring 18. A series of short radial calibration lines 20A are formed on the top surface of the lip 23 near its circumference.

A crossmember 24 extends from each side through the center of the ring 21 and has a straight line 25 on its top surface. The crossmember 24 has a laterally spaced circular portion 26 at one side which is approximately the same diameter as a golf ball. A rigid wire 27 extends through each side of the ring 21 perpendicular to the line 25 and its outer ends terminate a distance outwardly from the ring 21. The wire 27 extends beneath the cross-member 24 and the circular portion 26 at the center thereof. Thus, the wire 27 and line 25 form an upper cross-hair sight 28 at the center of the ring 21 and the wire 27 and circular portion 26 form a ball sight 29 laterally spaced from the center of the ring 21.

When the ring 21 is installed in the ring 18, the outwardly extended ends of the wire 27 are received in the slots 19 and the line 25 is superposed over the calibration lines 20. When the ring 21 is rotated relative to the ring 18, the circular ball sight 29 will rotate about the center cross-hair sight 28. Each calibration line 20A represents the distance in fractions of an inch the path of the ball will be above or below the center of the cup when putted from a predetermined distance from the cup.

Referring now to FIG. 5, a lower ball alignment member 30 is shown. The ball alignment member 30 may be installed on the vertical support post 11 for use in combination with the adjustable sighting device 15, or may be used separately. The ball alignment member 30 has a collar 31 with a wire 32 extending horizontally outwardly therefrom and the outer end of the wire has an arcuate C-shaped member 33 secured thereto. The C-shaped member 33 is spaced laterally from the wire 32 and has a second wire 34 extending rearwardly from the C-shaped member perpendicular to the wire 32. The inside diameter of the small collar 31 is of sufficient diameter to be slidably received and frictionally and rotatably engaged on the vertical support post 11. The curvature of the C-shaped member 33 is approximately the same as, or slightly larger than, the circular portion 26 in the ring 21. The relative locations of the center of the C-shaped member 33 and the intersection of the wires 32 and 34 are the same as the upper cross-hair sight 28 and the circular ball sight 29 in the ring 21.

As described in detail hereinafter, when used separately, the lower ball alignment member 30 is placed on the ground and positioned with the C-shaped portion 33 partially surrounding the ball B and the rearwardly extending wire 34 axially aligned with the desired path of the ball.

Referring to FIGS. 6, and 7, when the putting aid 10 is assembled for outdoor use, the ball alignment member 30 may be installed on the lower end of the vertical support post 11. The inside diameter of the small collar 31 is of sufficient diameter to be slidably received and frictionally and rotatably engaged on the vertical support post 11. As described above, the curvature of the C-shaped member 33 is approximately the same as, or slightly larger than, the circular portion 26 in the ring 21. The relative locations of the center of the C-shaped member 33 and the intersection of the wires 32 and 34 are the same as the upper cross-hair sight 28 and the circular ball sight 29 in the ring 21. Thus, when the ball alignment member 30 and the sighting device 15 are aligned in vertically spaced relation, the circular ball sight 29 of the ring 21 will be superposed over the C-shaped member 33 and the center cross-hair sight 28 of the ring 21 will be superposed over the intersection of the wires 32 and 34 of the ball alignment member 30.

It should be understood, that the ball alignment member 30 may be inverted to place the C-shaped portion 26 on the opposite side of that shown in the drawings and that the ring 21 may be installed in the ring 18 180° from that shown in order to facilitate use by left-handed persons.

Referring now to FIGS. 8, and 9, when the putting aid 10 is assembled for indoor use, a base member 40 is installed on the bottom of the vertical support post 11 and serves as the ball alignment means. The base member 40 has a flat rectangular bottom plate 41 and a vertical tubular extension 42 extending upward at one side to slidably receive and frictionally engage the plain end of the support post 11. A line 43 extends from the tubular extension to the opposite side of the flat bottom plate 41. A distance outwardly from the tubular extension 42, a second line 44 perpendicular to the first crosses the first line 43. A pair of arcuate C-shaped cutouts 45 are formed in the bottom plate 41 in laterally spaced opposed relation for receiving a golf ball. The line 44 is axially aligned with the center of the C-shaped cutouts 45. The relative location of the center of each C-shaped cutout 45 and the intersection of the lines 43 and 44 are the same as the circular ball sight 19 and line 25 and wire 27 of the ring 21, respectively. Thus, when the base member 40 and the sighting device 15 are aligned in vertically spaced relation, the circular ball sight 29 of the ring 21 will be superposed over one of the C-shaped cutouts 45 and the center cross-hair sight 28 of the ring 21 will be superposed over the intersection of the lines 43 and 44 of the bottom plate 41.

It should be understood, that the ring 21 may be installed in the ring 18 180° from that shown in order to align the circular ball sight 29 with the opposite C-shaped cutout 45 for use by left-handed persons.

OPERATION

To use the golf putting aid 10, the golfer first determines the line of the putt to be practiced by "reading the green" or, in other words, analyzes the conditions of the green. The golfer should determine the break (which way the green slopes), the type of grass (bent or Bermuda), whether the path is down green, cross green or into green, and the moisture of the green. These conditions affect the path of the ball. There are several ways in which the putting aid components may be used.

When used outdoors, the adjustable sighting device 15 may be installed at the upper end of the vertical support post 11 to form the embodiment shown in FIGS. 3 and 4. The vertical support post 11 is then placed into the ground with the putting aid 10 being located about six to eight feet from the hole or cup C. The circular ball sight 29 of the ring 21 is positioned in the direction the ball must start to accommodate the break. When properly aligned, the circular ball sight 29 will be positioned where the ball will be placed (between the cup and point of impact) and the outwardly extending wire 27 will be axially aligned with the desired path of the ball. When viewed vertically from a standing position, the circular ball sight 29 of the ring 21 will be superposed over the ball B and the center cross-hair sight 28 of the ring 21 will be superposed over the rear of the ball. In this position, the back of the ball B is slightly forward of the central cross-hair sight 28 of the ring 21. The upper wire 27 is superposed over the path of the ball BP through the center of the ball B. The line 25 of the ring 21 is perpendicular to the rear of the ball and the ball path BP. The golfer should also keep in mind that the ring 21 is approximately the same diameter as the hole or cup C, i.e., the cup is bigger than it appears from a distance.

The golfer then positions the putter while in a standing position and looking through the ring 21. The top edge of the putter head is placed parallel with the line 25 of the ring 21 with the sweet spot of the putter just behind the rear of the ball with the putter head resting comfortably on the ground.

Next, while standing and looking through the ring 21, the golfer positions his or her body. The feet, hips, and shoulders should be positioned parallel to the wire 27 extending through the ring 21 with the weight evenly distributed on the balls of the feet.

The head of the golfer should then be positioned by adjusting the weight on the balls of the feet, so that their eyes are directly over the wire 27 extending through the ring 21. Some putters have a white line on the head to indicate the sweet spot, and if this type of putter is used, the white line will be covered by the wire 27. It may be helpful during this practice for the golfer to close one eye as if aiming a rifle. The hands of the golfer should be positioned such that the leading edge of the putter is parallel to the line 25 of the ring 21.

Also when used outdoors, the adjustable sighting device 15 may be installed at the upper end of the vertical support post 11 and the lower ball alignment member 30 on the lower end of the post to form the embodiment shown in FIGS. 6 and 7. The vertical support post 11 is then placed into the ground with the ball alignment member 30 at the lower end resting on the surface of the green. The putting aid 10 should be located about six to eight feet from the hole or cup C to begin with. With reference to FIGS. 1, 6, and 7, the ball alignment member 30 is then positioned in the direction the ball must start to accommodate the break. When properly aligned, the C-shaped portion 33 will be positioned where the ball will be placed (between the cup and point of impact) and the rearwardly extending wire 34 will be axially aligned with the path of the ball.

The ring 21 is then rotated such that when viewed vertically from a standing position, the circular ball sight 29 of the ring 21 will be superposed over the C-shaped member 33 and the center cross-hair sight 28 of the ring 21 will be superposed over the intersection of the wires 32 and 34 of the ball alignment member 30.

The ball B is then placed into the C-shaped portion 33 of the ball alignment member 30. In this position, the back of the ball B is slightly forward of the central cross-hair sight 28 of the ring 21. The upper wire 27 is superposed over the lower wire 34 and both wires form a rearward extension of the path of the ball BP through the center of the ball B. The line 25 of the ring 21 is superposed over the wire 32 of the ball alignment member 30 and both are perpendicular to the rear of the ball and the ball path BP. The golfer should also keep in mind that the ring 21 is approximately the same diameter as the hole or cup C, i.e., the cup is bigger than it appears from a distance.

The golfer then positions the putter while in a standing position and looking through the ring 21 The top edge of the putter head P is placed parallel with the line 25 of the ring 21 with the sweet spot of the putter just behind the rear of the ball with the putter head resting comfortably on the ground.

Next, while standing and looking through the ring 21, the golfer positions his or her body. The feet, hips, and shoulders should be positioned parallel to the wire 27 extending through the ring 21 with the weight evenly distributed on the balls of the feet.

The head of the golfer should then be positioned by adjusting the weight on the balls of the feet, so that their eyes are directly over the wire 27 extending through the ring 21. Some putters have a white line on the head to indicate the sweet spot, and if this type of putter is used, the white line will be covered by the wire 27. It may be helpful during this practice for the golfer to close one eye as if aiming a rifle. The hands of the golfer should be positioned such that the leading edge of the putter is parallel to the line 25 of the ring 21.

When used indoors, the adjustable sighting device 15 is installed at the upper end of the vertical support post 11 and the lower end of the post is installed in the vertical tubular extension 42 of the base member 40 to form the embodiment shown in FIGS. 8 and 9. The base member 40 serves as the ball alignment means. The putting aid 10 should be located about six to eight feet from the hole or target to begin with. The base member 40 is then positioned in the direction the ball must start. When properly aligned, the arcuate C-shaped cutout 45 at one side of the bottom plate 41 is positioned where the ball will be placed and the line 44 is axially aligned with the desired path of the ball.

The ring 21 is then rotated such that when viewed vertically from a standing position, the circular ball sight 29 of the ring 21 will be superposed over the C-shaped cutout 45 and the center cross-hair sight 28 of the ring 21 will be superposed over the intersection of the lines 43 and 44 of the base member 40. The ball B is then placed into the C-shaped cutout 45. In this position, the back of the ball B is slightly forward of the central cross-hair sight 28 of the ring 21. The upper wire 27 is superposed over the lower line 44 and forms a rearward extension of the path of the ball through the center of the ball B. The line 25 of the ring 21 is superposed over the line 43 of the base member 40 and both are perpendicular to the rear of the ball and the ball path. The golfer then positions the putter while in a standing position and looking through the ring 21. The top edge of the putter head P is placed parallel with the line 25 of the ring 21 with the sweet spot of the putter just behind the rear of the ball. The golfer then positions his body, head, and hands while standing and looking through the ring 21, and the putter head, as described above.

When desired, the lower ball alignment member 30 may be used separately from the other components and used indoors or outdoors. In the event that the golfer does not wish to move the ball being putted, the lower ball alignment member is placed on the ground and positioned with the C-shaped portion 33 partially surrounding the rear portion of ball B and the rearwardly extending wire 34 is axially aligned with the desired path of the ball, taking into account the break of the green. In the event that the golfer desires to practice his putting shot and can selectively place the ball, the ball alignment member 30 is positioned in the direction the ball must start to accommodate the break. When properly aligned, the C-shaped portion 33 will be positioned where the ball will be placed (between the cup and point of impact) and the rearwardly extending wire 34 will be axially aligned with the path of the ball.

In either case, the golfer then positions the putter while in a standing position and looking down on the ball. The top edge of the putter head is positioned parallel with the wire 32 with the sweet spot of the putter just behind the rear of the ball. Next, the golfer positions his or her body. The feet, hips, and shoulders should be positioned parallel to the wire 34 extending from the rear of the C-shaped portion 33 with the weight evenly distributed on the balls of the feet. The head of the golfer should then be positioned by adjusting the weight on the balls of the feet, so that his or her eyes are directly over the ball and wire 34. Some putters have a white line on the head to indicate the sweet spot, and if this type of putter is used, the white line should be directly above the wire 34. It may be helpful during this practice for the golfer to close one eye as if aiming a rifle. The hands of the golfer should be positioned such that the leading edge of the putter is parallel to the wire 32.

After having completed either of the alignment methods described above, and with the putter in and, the golfer should waggle the putter, look to the hole or cup C in the green, or the target, taking note of the path the ball should follow, and relax into a comfortable putting stance to acquire the feel for the proper putting stroke.

The distance of the putt will determine the length of the backswing, keeping in mind the touch of the person putting. It should be noted that the putting aid, when properly positioned, will assure that the putter blade is perpendicular to the desired ball path which has been set to compensate for the break of the green and speed of the grass.

It is recommended that the golfer use six balls and practice stroking each ball until the balls start going into the hole. Once several attempts have been made, and a fairly consistent path has been observed, it may be necessary to make some minor adjustments to the putting aid to assure that it is lined up properly to correspond to the break and speed of the green. This is accomplished by rotating the ring 21 to move the line 25 or the next higher or lower calibration mark 20A into register with the index mark 20. Each calibration line 20A represents the distance in fractions of an inch the path of the ball will be above or below the center of the cup when putted from a predetermined distance from the cup.

The golfer should continue putting until twelve successful putts in a row have been made, after which the putting aid 10 may be removed, or the sighting device 15 swiveled out of the way so that the same putt can be made without the use of the putting aid. The putting aid can be again placed back in position and the practice exercise repeated until twelve successful puts have been made. The same putting techniques may be practiced indoors by using the base plate as shown in the embodiment of FIG. 8.

The practice exercise can be tiring on one's back, and it is recommended that the golfer pace themself and straighten up after every third putt.

While this invention has been described fully and completely with special emphasis upon a preferred embodiment, it should be understood that within the scope of the appended claims the invention may be practiced otherwise than as specifically described herein.

We claim:

1. A golf putting aid for practicing a proper putting technique comprising;

a support post having an upper and lower end adapted at one end to be positioned in an upright vertical position, a sighting member on the upper end of said support post and having a circular aperture approximately the same diameter as the target hole with an upper ball/club path marker extending diametrically across said circular aperture and outwardly a distance from said circular aperture and an upper clubhead alignment marker extending diametrically across said aperture perpendicular thereto to form a cross hair sight at the center of said circular aperture, and a circular ball sight member within said circular aperture at one side of said upper clubhead alignment marker and having approximately the same diameter as a golf ball, said upper ball/club path marker extending through the center of said circular ball sight member, said sighting member capable of being positioned such that when viewed by a golfer from a standing position said upper ball/club path marker will be superposed above a desired ball path, said circular ball sight member will be superposed over the golf ball, and said upper clubhead alignment marker will be superposed above the rear of the golf ball.

2. A golf putting aid according to claim 1 in which said support post has a pointed ground penetrating extension at one end with a longitudinal portion configured to prevent rotation of said support post when placed in the ground.

3. A golf putting aid according to claim 1 in which said sighting means comprises a collar member slidably engaged on said support post and having an arm extending horizontally outwardly therefrom, a flat ring at the outer end of said arm having an inside diameter approximately the same as the diameter of a regulation golf hole cup, a first wire extending diametrically across the center of said flat ring and the ends thereof terminating a distance outwardly from said flat ring and defining an upper club path marker, and a second wire extending diametrically across the center of said flat ring perpendicular to said first wire and defining an upper clubhead alignment marker perpendicular to the upper club path marker.

4. A golf putting aid according to claim 3 in which said circular ball sight member is a smaller flat ring and said first wire passes through the center thereof.

5. A golf putting aid according to claim 1 in which said sighting means comprises a collar member slidably engaged on said support post and having an arm extending horizontally outwardly therefrom, a first flat ring at the outer end of said arm having an inside diameter approximately the same as the diameter of a regulation golf hole cup and a series of calibration lines on the top surface of said first flat ring, a second flat ring slidably mounted within said first flat ring and being rotatable relative thereto, a first wire extending diametrically across the center of said second flat ring and the ends thereof terminating a distance outwardly from said first flat ring and defining an upper club path marker, and a crossmember extending diametrically across the center of said second flat ring perpendicular to said first wire and bearing a straight line defining an upper clubhead alignment marker perpendicular to the upper club path marker, said straight line capable of being selectively positioned adjacent said calibration lines upon rotation of said second flat ring to represent the distance in fractions of an inch the path of the ball will be above or below the center of an imaginary line when the ball is putter from a predetermined distance from the target.

6. A golf putting aid according to claim 1 including;

ball alignment means on the lower end of said support post spaced vertically below said sighting member and having a golf ball receptacle with a lower ball/club path marker extending axially from said golf ball receptacle and a lower clubhead alignment marker perpendicular thereto, said ball alignment member capable of being positioned with said lower ball/club path marker forming an extension of a desired ball path and said sighting member being positioned such that when viewed by a golfer from a standing position said upper and lower ball/club path markers will be superposed, said upper and lower clubhead alignment markers will be superposed, and said circular ball sight member will be superposed over the golf ball.

7. A golf putting aid according to claim 6 in which said ball alignment means comprises a collar slidably and rotatably engaged on said support post and having a first rigid wire extending horizontally outwardly therefrom, an arcuate C-shaped member secured to the outer end of said first rigid wire with the open portion of the C-shape positioned at a right angle to said first rigid wire for receiving a golf ball, and a second rigid wire extending from the closed portion of the C-shape perpendicular to said first rigid wire and in axial alignment with the center axis of the C-shape and defining said lower club path marker, the center axis of said C-shape and said second rigid wire forming an extension of a desired ball path and said first rigid wire defining said lower clubhead alignment marker being perpendicular to the desired ball path.

8. A golf putting aid according to claim 6 in which said ball alignment means comprises flat rectangular base plate having a vertical tubular extension at one side which is slidably and rotatably engaged on said support post, said base plate having a first straight line extending horizontally outwardly from said tubular extension and a second straight line crossing said first straight line perpendicular thereto a distance outwardly from said tubular extension, said first straight line defining said lower clubhead alignment marker and said second straight line defining said lower ball/club path marker, said base plate having an inwardly extending arcuate C-shaped cutout on at least one side for receiving a golf ball with the open portion of the C-shape positioned at a right angle to said first straight line and the center axis of said C-shaped cutout in axial alignment with said second straight line, the center axis of said C-shaped cutout and said second straight line forming an extension of a desired ball path and said first straight line defining said clubhead alignment marker being perpendicular to the desired ball path.

9. A golf putting aid according to claim 8 in which said base plate has a pair of said arcuate C-shaped cutouts each extending inwardly from opposite sides in laterally spaced opposed relation and the center axis of each said C-shaped cutout in axial alignment with said second straight line.

* * * * *